US011142986B2

(12) United States Patent
Sanchez et al.

(10) Patent No.: US 11,142,986 B2
(45) Date of Patent: Oct. 12, 2021

(54) ISOLATION ASSEMBLY

(71) Applicant: SCHLUMBERGER TECHNOLOGY CORPORATION, Sugar Land, TX (US)

(72) Inventors: Mariano Sanchez, Houston, TX (US); Isaac Aviles Cadena, Sugar Land, TX (US); Afou Keshishian, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 142 days.

(21) Appl. No.: 16/305,141

(22) PCT Filed: May 31, 2016

(86) PCT No.: PCT/US2016/034972
§ 371 (c)(1),
(2) Date: Nov. 28, 2018

(87) PCT Pub. No.: WO2017/209727
PCT Pub. Date: Dec. 7, 2017

(65) Prior Publication Data

US 2020/0325748 A1 Oct. 15, 2020

(51) Int. Cl.
*E21B 43/10* (2006.01)
*E21B 33/12* (2006.01)
(Continued)

(52) U.S. Cl.
CPC ..... *E21B 33/1208* (2013.01); *E21B 34/14* (2013.01); *E21B 23/06* (2013.01);
(Continued)

(58) Field of Classification Search
CPC .. E21B 33/1208; E21B 34/14; E21B 2200/06; E21B 23/06; E21B 33/1285; E21B 43/105
(Continued)

(56) References Cited

U.S. PATENT DOCUMENTS 7,424,909 B2 9/2008 Roberts et al.
7,775,279 B2 8/2010 Marya et al.
(Continued)

FOREIGN PATENT DOCUMENTS

WO WO2007015766 A1 2/2007
WO WO2016065291 A1 4/2016

OTHER PUBLICATIONS

International Search Report and Written Opinion for corresponding PCT Application No. PCT/US2016/034972, dated Jan. 6, 2017, 16 pages.

*Primary Examiner* — Taras P Bemko
(74) *Attorney, Agent, or Firm* — Kelly McKinney; Michael Dae

(57) ABSTRACT

An apparatus that is usable with a well includes a tubular assembly and an expansion tool. The tubular assembly has a radially contracted state and includes a restriction. The restriction is adapted to catch an object that is deployed into the well to form a fluid barrier when caught by the restriction. The expansion tool is deployed downhole with the tubular assembly inside a tubing string. The expansion tool is adapted to deform the tubular assembly to anchor the tubular assembly to the tubing string.

21 Claims, 11 Drawing Sheets

(51) Int. Cl.
*E21B 34/14* (2006.01)
*E21B 23/06* (2006.01)
*E21B 33/128* (2006.01)

(52) U.S. Cl.
CPC ..... *E21B 33/1285* (2013.01); *E21B 43/105* (2013.01); *E21B 2200/06* (2020.05)

(58) Field of Classification Search
USPC ..... 166/217, 387
See application file for complete search history.

(56) References Cited

U.S. PATENT DOCUMENTS

| | | | | |
|---|---|---|---|---|
| 7,810,558 | B2 | 10/2010 | Shkurti et al. | |
| 7,980,300 | B2 | 7/2011 | Roberts et al. | |
| 8,047,280 | B2 | 11/2011 | Tran et al. | |
| 8,211,247 | B2 | 7/2012 | Marya et al. | |
| 8,211,248 | B2 | 7/2012 | Marya | |
| 9,752,407 | B2 | 9/2017 | Jacob et al. | |
| 2002/0060078 | A1* | 5/2002 | Cook | E21B 33/10 166/380 |
| 2013/0186616 | A1 | 7/2013 | Xu et al. | |
| 2014/0054047 | A1* | 2/2014 | Zhou | E21B 23/04 166/382 |
| 2014/0060837 | A1 | 3/2014 | Love | |
| 2016/0186511 | A1* | 6/2016 | Coronado | E21B 33/129 166/381 |
| 2016/0230498 | A1* | 8/2016 | Walton | E21B 33/1294 |

* cited by examiner

ISOLATION ASSEMBLY

BACKGROUND

Well stimulation operations may be conducted downhole in a well that extends through a hydrocarbon bearing formation for purposes of enhancing hydraulic communication between the formation and the well. As an example, a jetting operation may be performed to remove debris that was introduced during the drilling of the well or during downhole perforating operations. In this manner, a jetting tool may be run, or deployed, downhole on a coiled tubing string, and an acidic jetting fluid may be communicated via the coiled tubing string through nozzles of the tool to remove the debris from the near wellbore to increase the well's permeability.

Hydraulic fracturing is another example of a well stimulation operation. In hydraulic fracturing, fluid in the well is pressurized to fracture the surrounding formation rock and introduce a fracture pack (proppant, for example) into the resulting fractures for purposes of holding the fractures open when the pressure is released. Well stimulation operations may be performed sequentially in multiple isolated segments, or stages, of the well and may involve the deployment and use of various downhole tools, such as fracturing plugs, sleeve valves, and so forth.

SUMMARY

The summary is provided to introduce a selection of concepts that are further described below in the detailed description. This summary is not intended to identify key or essential features of the claimed subject matter, nor is it intended to be used as an aid in limiting the scope of the claimed subject matter.

In accordance with an example implementation, a technique includes deploying an isolation assembly into a tubing string that was previously installed in a well; deforming the isolation assembly at a downhole location in the well to secure the assembly to the tubing string; receiving an object in a restriction of the isolation assembly; and using the received object in the isolation assembly to perform a downhole operation in the well.

In accordance with another example implementation, an apparatus that is usable with a well includes a tubular assembly and an expansion tool. The tubular assembly has a radially contracted state and includes a restriction. The restriction is adapted to catch an object that is deployed into the well to form a fluid barrier when caught by the restriction. The expansion tool is deployed downhole with the tubular assembly inside a tubing string. The expansion tool is adapted to deform the tubular assembly to anchor the tubular assembly to the tubing string.

In accordance with yet another example implementation, a system that is usable with a well includes a tubing string and an isolation assembly. The tubing string supports a wellbore, and the wellbore has multiple stages. The isolation assembly is deployed in the central passageway of the tubing string to form an isolation barrier for a given stage of the multiple stages. The isolation assembly includes a tubular assembly and an expansion tool. The tubular assembly has a radially contracted state and includes a seat. The seat is adapted to catch an untethered object that is deployed into the central passageway of the tubing string to form a fluid barrier due to the untethered object being caught by the seat. The expansion tool is deployed downhole with the tubular member as a unit inside the tubing string. The expansion tool is adapted to deform the tubular assembly to anchor the tubular assembly to the tubing string.

Advantages and other features will become apparent from the following drawings, description and claims.

DETAILED DESCRIPTION

Figure 1A:
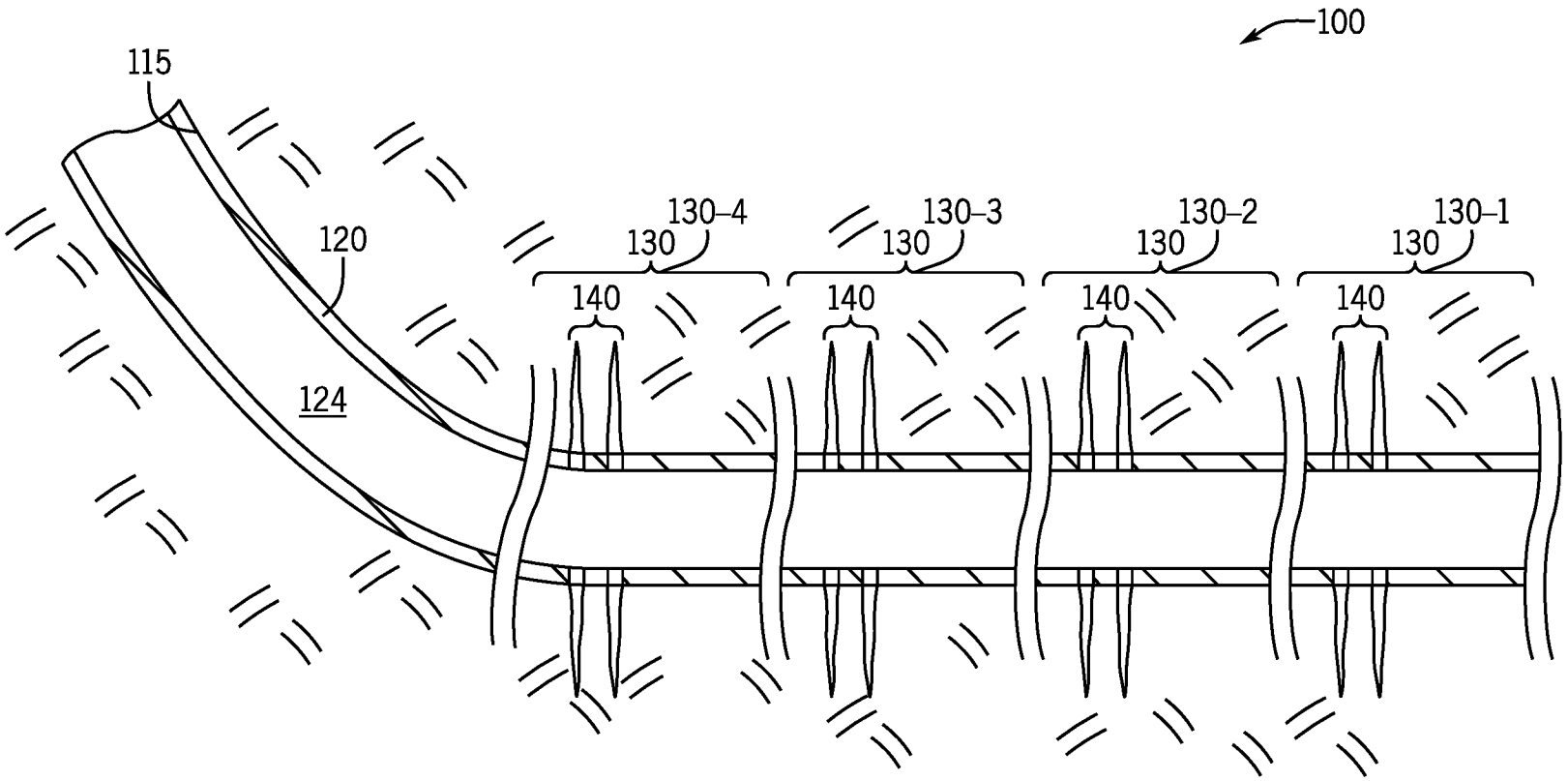
FIG. 1A a schematic diagram of a well according to an example implementation.

In general, systems and techniques are disclosed herein to deploy and use a deformable isolation assembly in a well for purposes of performing a downhole operation. In this regard, the isolation assembly that is disclosed herein has a radially contracted state, which allows the assembly to be run downhole in the well inside the central passageway of a tubing string (a casing string, for example) that was previously installed in the well. When at the appropriate downhole location, the isolation assembly may be radially expanded and secured, or anchored, to the tubing string to form a downhole obstruction, or fluid barrier, inside the central passageway of the tubing string; and this fluid barrier may then be used in connection with a downhole operation.

The downhole operation may be any of a number of operations (a stimulation operation, perforating operation, a jetting operation and so forth) that rely on a fluid barrier inside a tubing string.

In accordance with example implementations that are disclosed herein, the isolation assembly has a central passageway and a restriction that is formed in its central passageway for purposes of allowing an object to be landed in the restriction to form the fluid barrier after the assembly had been anchored in place and radially expanded. As a more specific example, the isolation assembly may be a fracturing plug assembly, and the restriction may be an inner, object catching seat. In this context, "object catching seat" refers to the seat being constructed to catch an object that is deployed through the tubing string, such as a ball, a dart, a barrel, a rod, or any other object that is constructed to land in the seat to form the fluid barrier.

In general, the isolation assembly is run downhole in a collapsed, or unexpanded state (also referred to as the "radially contracted state" herein), which allows the isolation assembly to have a smaller overall cross-section. This smaller cross-section allows the isolation assembly to be freely run downhole inside the central passageway of a tubing string without being impeded by features of the string. As further described herein, after being placed in the appropriate downhole location, the isolation assembly may be transitioned to its expanded state (also called the "radially expanded state" herein) in which the isolation assembly is secured, or anchored, to the tubing string wall. In this radially expanded stage, the isolation assembly may be used to catch an object that is deployed in the central passageway of the string for purposes of forming a fluid barrier.

In accordance with example implementations, in its expanded state, the isolation assembly is constructed to receive, or catch, an object, which is deployed in the passageway of the tubing string. In accordance with example implementations, the object may be a solid object that is constructed to be caught by the isolation assembly's restriction so that the landed object in conjunction with the assembly substantially closes off fluid communication through the assembly to form a downhole fluid barrier. "Substantially closes off" fluid communication refers to fluid communication through the isolation assembly being inhibited to the extent that a fluid column above the assembly may be pressurized to perform a downhole operation (pressurized to conduct a hydraulic fracturing operation, for example). Fluid leakage between the landed object and the restriction may or may not occur, depending on the particular implementation.

The object that lands in the restriction may be an "untethered object," in accordance with example implementations. In this context, an "untethered object" refers to an object that is communicated downhole through the passageway of the string along at least part of its path without the use of a conveyance line (a slickline, a wireline, a coiled tubing string and so forth). As an example, the untethered object may be deployed from the Earth surface of the well. In accordance with further example implementations, the untethered object may be run downhole into the well by a conveyance mechanism, such as a wireline, slickline, coiled tubing string or jointed tubing string and then released to travel into the tubing string containing the isolation assembly to land in the assembly's restriction. In accordance with further example implementations, the object may be tethered to the end of a conveyance mechanism or tool, which is run downhole to position the object in the isolation assembly's restriction. Thus many implementations are contemplated, which are within the scope of the appended claims.

In accordance with example implementations described herein, the isolation assembly includes a sleeve that is constructed to be deformably expanded downhole in the well to anchor the isolation assembly to the tubing string. For example, in accordance with some implementations, the isolation assembly may be run downhole with a setting tool on a conveyance mechanism, such as a tubular string, coiled tubing, a wireline, and so forth. After being placed in the proper position, the setting tool may be actuated using actions initiated from the Earth surface of the well for purposes of exerting a force to deform the sleeve to cause the sleeve to radially expand and become anchored to the surrounding wall of the tubing string.

In accordance with example implementations, the sleeve of the isolation assembly may be radially expanded to anchor the sleeve to the tubing string, and the sleeve may contain a restriction to form a seat to catch an untethered object to form a fluid barrier in the tubing string. More specifically, in accordance with example implementations that are described herein, the setting tool may have an expansion member that, for the assembly's radially contracted state, has an overall outer dimension that is greater than the overall inner dimension of the isolation assembly; and when the isolation assembly has been run downhole and placed at the appropriate target downhole location, the conveyance mechanism may be pulled uphole to draw the expansion tool member through the interior of the isolation assembly to deform and radially expand isolation assembly. After the isolation assembly has been radially expanded and anchored in place, the setting tool and conveyance mechanism may then be pulled out of the well; and then an object may be deployed to land in the restriction of the isolation assembly to form a fluid barrier.

In accordance with further example implementations, the seat of the isolation assembly may be separate from the sleeve of the isolation assembly. In this manner, the isolation assembly may include a seat member (containing the seat) and a deformable sleeve. A setting tool on which the isolation assembly is mounted may be run downhole in the central passageway of the tubing string to a target downhole location. The setting tool may then be actuated to radially expand the sleeve member and force the sleeve member between the seat member and the tubing string wall for purposes of forming a wedge, or friction, fit between the seat member and the tubing string.

As described herein, in accordance with some implementations, the sleeve member may be run into the well mounted uphole of the seat member on the setting tool. A tension mandrel of the setting tool may be secured to the seat member so that the setting tool may be actuated to engage a sleeve member of the isolation assembly to exert a force on the sleeve member and axially translate the sleeve member to force the sleeve member into a seat member of the isolation assembly. In this manner, the force that is applied by the setting tool and the axial translation of the sleeve member caused by this force causes the sleeve member to radially expand to form a wedge between the seat member and the tubing string wall.

In accordance with further example implementations that are described herein, the isolation assembly may include a sleeve member and a seat member, with the seat member being mounted on the setting tool uphole of the sleeve member. A tension mandrel of the setting tool may be secured to the sleeve member so that the setting tool may be actuated to apply a force to the seat member to axially translate the seat member into the sleeve member to cause the sleeve member to deform and radially expand to form a wedge between the seat and the tubing string wall.

Referring to FIG. 1A as a more specific example, in accordance with some implementations, a well 100 includes a wellbore 115, which traverses one or more hydrocarbon-bearing formations. As an example, the wellbore 115 may be lined, or supported, by a tubing string 120, as depicted in FIG. 1A. The tubing string 120 may be a liner string or a casing string that is cemented to and supports the wellbore 115 (such wellbores are typically referred to as "cased hole" wellbores); or the tubing string 120 may be secured to the surrounding formation(s) by packers (such wellbores typically are referred to as "open hole" wellbores). In general, the wellbore 115 may extend through multiple segments, or stages 130 (four example stages 130-1, 130-2, 130-3, and 130-4, being depicted in FIG. 1A), of the well 100.

It is noted that although FIG. 1A and other figures disclosed herein depict a lateral wellbore, the techniques and systems that are disclosed herein may likewise be applied to vertical wellbores. Moreover, in accordance with some implementations, the well 100 may contain multiple wellbores, which contain tubing strings that are similar to the illustrated tubing string 120 of FIG. 1A. The well 100 may be a subsea well or may be a terrestrial well, depending on the particular implementation. Additionally, the well 100 may be an injection well or may be a production well. Thus, many implementations are contemplated, which are within the scope of the appended claims.

Multiple stage operations (fracturing or other stimulation operations) may be performed along the wellbore 115, one stage 130 at a time. In this manner, a given stage 130 may be hydraulically isolated from the other stages 130, a given operation may be performed in the isolated stage, the isolation may be removed, and then these same steps may be performed for the next stage. The downhole operations may be performed in the stages 130 in a particular directional order, in accordance with example implementations. For example, in accordance with some implementations, downhole operations may be conducted in a direction from a toe end of the wellbore to a heel end of the wellbore 115. In further implementations, the multiple stage downhole operations may be connected from the heel end to the toe end of the wellbore 115. In accordance with further example implementations, the multiple stage operations may be performed in no particular order, or sequence.

FIG. 1A depicts that fluid communication with the surrounding hydrocarbon formation(s) has been enhanced through sets 140 of perforation tunnels that, for this example, are formed in each stage 130 and extend through the tubing string 120. It is noted that each stage 130 may have multiple sets of such perforation tunnels 140. Although perforation tunnels 140 are depicted in FIG. 1A, it is understood that other techniques other than perforating may be used to establish/enhance fluid communication with the surrounding formation (s). For example, the fluid communication may be alternatively established/enhanced by jetting an abrasive fluid using a jetting tool; opening sleeve valves of the tubing string 120; and so forth. One or more multiple stage stimulation operations may be performed after such operations. In accordance with further example implementations, the multiple stage stimulation operation(s) may be performed without first perforating or jetting.

Figure 1B:
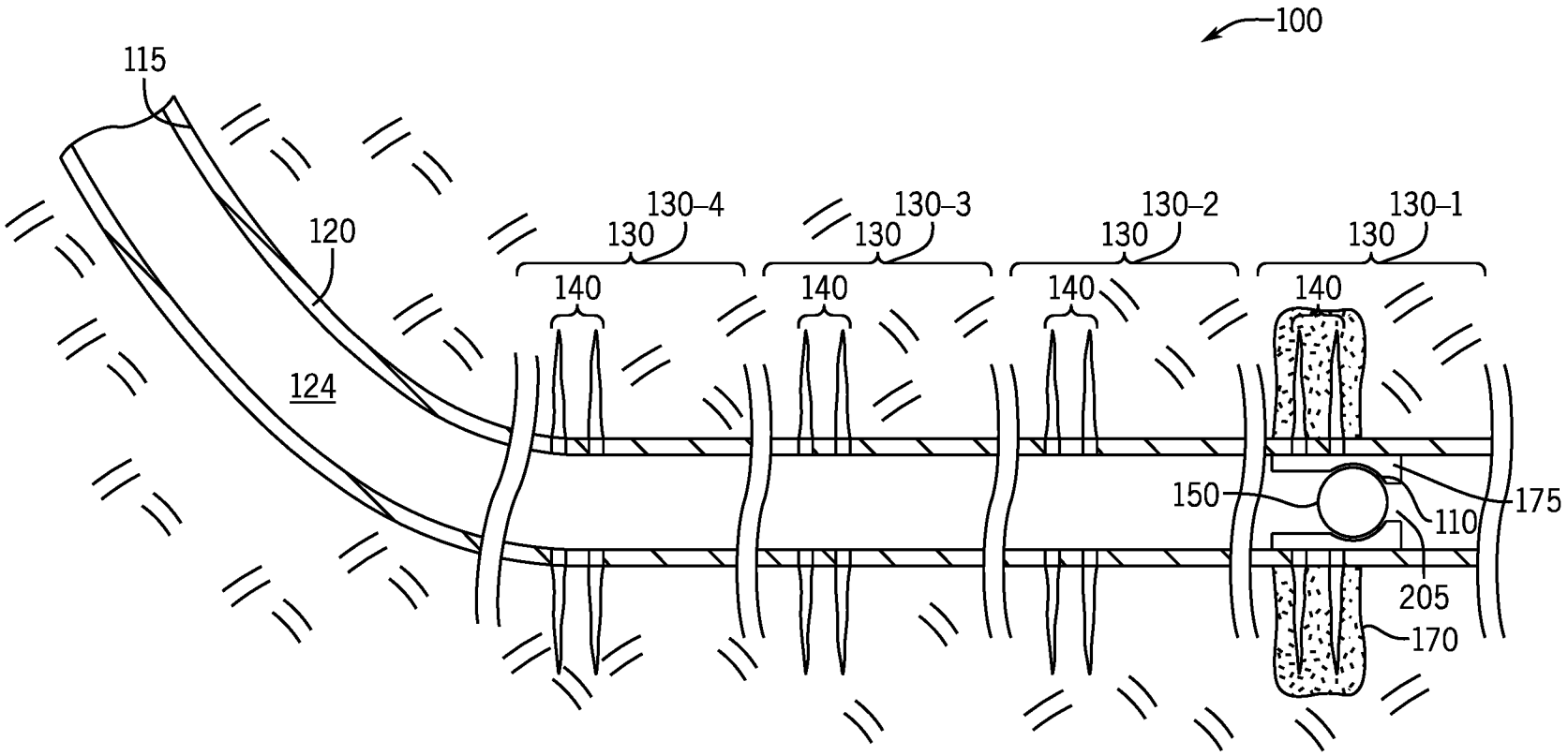
FIG. 1B is a schematic diagram of the well of FIG. 1A illustrating the formation of a fluid barrier downhole in a tubing string of the well and the use of the fluid barrier in a stimulation operation conducted in an isolated stage of the well according to an example implementation.

Referring to FIG. 1B in conjunction with FIG. 1A, as an example, a stimulation operation may be performed in the stage 130-1 by deploying an isolation assembly 175 into the tubing string 120 on a setting tool (not depicted in FIGS. 1A and 1B) in a radially contracted state of the assembly 175 and running the assembly 175 to a target downhole location in a given stage 130 of the well. As described herein, the setting tool may then be used to radially expand the isolation assembly 175 and anchor the isolation assembly 175 to the tubing string 120. For the example of limitation that is depicted in FIG. 1B, the isolation assembly 175 has been radially expanded and anchored to the tubing string 120 in the stage 130-1. After the isolation assembly 175 has been installed, a solid object (here, an activation ball 150) may be deployed so that the object lands in a restriction of the assembly 175 to form a fluid barrier, as shown in FIG. 1B. As depicted in FIG. 1B, the fluid barrier may be used to divert a stimulation fluid (fracturing fluid pumped into the tubing string 120 from the Earth surface, for example) into the formation in the stage 130-1.

Figure 2A:
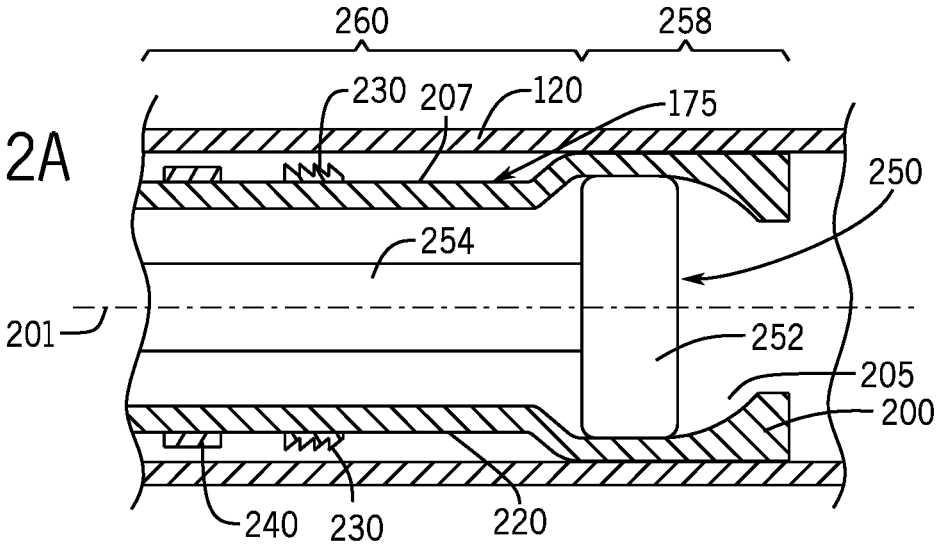
FIG. 2A is a schematic diagram illustrating an isolation assembly in its radially contracted state according to an example implementation.

The radially contracted state, or run-in-hole state, of the isolation assembly 175, in accordance with an example implementation, is depicted in FIG. 2A. Referring to FIG. 2A in conjunction with FIG. 1B, in accordance with example implementations, the isolation assembly 175 includes a tubular body, or sleeve 207, which is coaxial with a longitudinal axis 201 of isolation assembly 175. The longitudinal axis 201, in turn, is generally coaxial with the outer tubing string 120. The sleeve 207 has a restriction 200, which circumscribes the longitudinal axis 201 and is sized to catch a solid object, such as activation ball 150 (FIG. 1B), to form a fluid barrier. The restriction 205 may be symmetrical about the longitudinal axis to form a seat, as depicted in FIG. 2A. However, in accordance with further example implementations, the restriction 205 may be asymmetric with respect to the longitudinal axis 200. In accordance with example implementations, the restriction 205 may have a profile that complements the profile of the object to be landed in the restriction 205. For example, the restriction 205 may have a curved surface that corresponds to the spherical outer surface of a ball, such as activation ball 150 (see FIG. 1B).

As depicted in FIG. 2A, for the radially contracted state of the isolation assembly 175, the sleeve 207 generally has two axial segments that are associated with different outer cross-sections: an expanded section 258, which contains an expansion member 252 of an expansion tool 250; and a contracted section 260, which is the part of the assembly 175 that is radially expanded by the expansion tool 252 to anchor the assembly 175 to the wall of the tubing string 120. The overall outer dimension (outer diameter, for example) of the expanded section 258 is sufficiently small enough to pass through the tubing string 120 to allow the isolation assembly 175 to be run downhole. The isolation assembly 175 includes one or multiple anchor members 230 (multiple anchor members 130 for the example implementations depicted in the figures) and a seal element 240. The anchor members 230 and the seal element 240 circumscribe the section 260 of the sleeve 207 and circumscribe the longitudinal axis 201. The overall outer dimension (outer diameter, for example) of the isolation assembly 175 at the anchor members 230 and at the seal element 240 is sufficiently small enough to allow the isolation assembly 175 to pass through the tubing string 120 when the assembly 175 is run downhole.

The contracted segment of the sleeve 207, in accordance with example implementations, is radially expanded by the expansion member 252 of the expansion tool 250 for purposes of enlarging the inner passageway of the isolation assembly 175, radially extending the anchor members 230 to secure the assembly 175 to the tubing string wall and radially expanding the seal element 240 to form a seal (fluid seal, for example) between the sleeve 207 and the tubing string wall.

In accordance with example implementations, the anchor member 230 may have a profile or surface that is constructed to grip the inner surface of the tubing string 120 to secure the isolation assembly 175 to the tubing string 120. For example, in accordance with some implementations, the anchor member 230 may have a relatively high coefficient of friction (as compared to the inner wall of the tubing string 120, for example) to allow the member 230 to secure the isolation assembly 175 to the tubing string 120 when the member 230 is radially pushed against the wall of the string 120.

In accordance with some implementations, the anchor member 230 may contain pointed surfaces, or "teeth." The teeth may be constructed of a metal that is relatively harder than the metal of the tubing string 120 so that the teeth "bite" into the tubing string wall to anchor the isolation assembly 175 to the tubing string 120. In accordance with further example implementations, the anchor member 230 may be a slip, similar to a slip used in a packer. In this manner, for these example implementations, the isolation assembly 175 may contain thimbles, or collars, which are moved closely axially together due to the expansion of the sleeve 207 (or due to actuation by a setting tool, as another example) to cause the anchor members 230 (disposed between the thimbles) to radially extend into and engage the tubing string wall.

In accordance with example implementations, the seal element 240 may be an elastomer ring that radially expands with the sleeve 207 to form a fluid tight or near fluid tight seal between the isolation assembly 175 and the tubing string 120. Materials other than an elastomer may be used for the seal element 240, in accordance with further example implementations. For example, in accordance with some implementations, the seal element 240 may be formed from metal to form a metal-to-metal seal between the isolation assembly 175 and the tubing string 120. In accordance with further example implementations, the isolation assembly 175 may not have a seal element.

As depicted in FIG. 2A, in accordance with example implementations, the expansion member 252 may be a solid member (a solid right circular cylindrical metal piece, for example) and has an outer diameter that corresponds to the inner diameter of the expanded section 258 of the sleeve 207 when the isolation assembly 175 is run downhole. Moreover, as also shown in FIG. 2A, the expansion member 252 may be attached to a conveyance mechanism 254 (a coiled tubing string, for example) that is used to draw the expansion member 252 uphole to radially expand the section 260. In this manner, in accordance with example implementations, the isolation assembly 175 may be run downhole on a conveyance mechanism, such as a tubing string 255 (FIG. 2B), that is attached to the sleeve 207 to a target location inside the outer tubing string 120. The conveyance mechanism 254 extends inside the tubing string 255. When the isolation assembly 175 is in the appropriate position, the conveyance mechanism 254 may be pulled uphole to move the expansion member 252 through the sleeve 207 to deform and radially expand the section 260. In accordance with example implementations, the conveyance mechanism 254 may be run downhole with the tubing string 255 and may be initially attached (via one or more shear pins, for example) to the string 255 during the running of the isolation assembly 175 downhole.

Figure 2B:
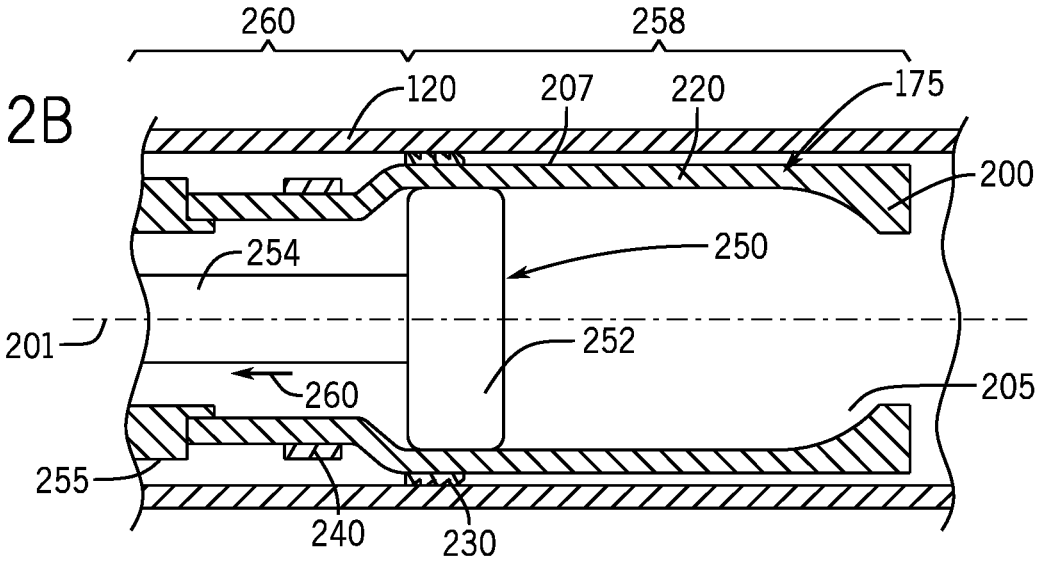
FIG. 2B is a schematic diagram illustrating the isolation assembly of FIG. 2A during the radial expansion of the assembly according to an example implementation.

FIG. 2B depicts the isolation assembly 175 in an intermediate state during the radial expansion of the assembly 175. More specifically, FIG. 2B depicts the expansion tool 250 being moved uphole in a direction 260 to cause the corresponding expansion of the sleeve 207. For the state depicted in FIG. 2B, the contracted section 260 has shortened, and the anchor members 230 are extended to grip the wall of the tubing string 120 to anchor the isolation assembly 175 to the tubing string 120.

Figure 2C:
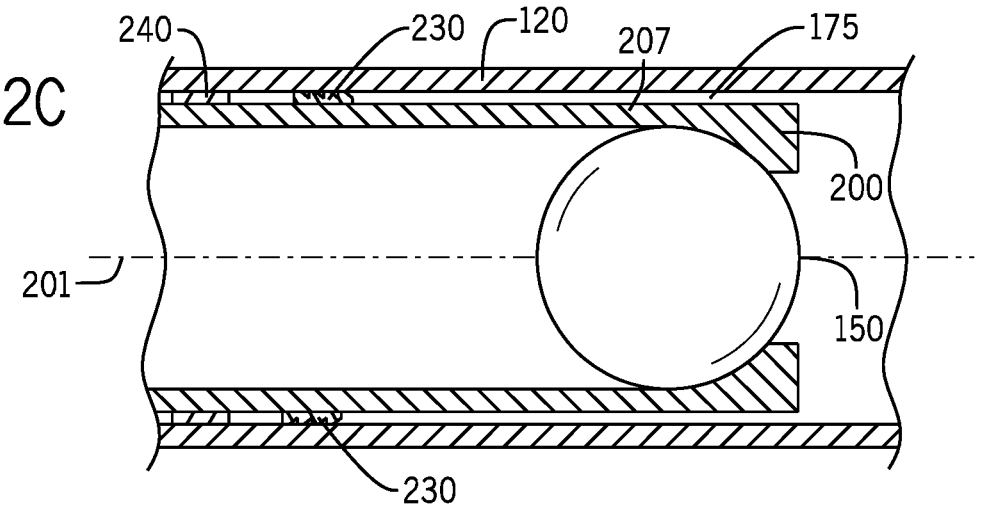
FIG. 2C is a schematic diagram of the isolation assembly of FIG. 2A illustrating the isolation assembly in its radially expanded state according to an example implementation.

FIG. 2C depicts the isolation assembly 175 in its radially expanded state, after the expansion tool 250 has been pulled out of the well, and an activation ball 150 has been deployed and landed in the restriction 205. In accordance with example implementations, in its radially expanded state, the seal element 240 has been radially expanded to energize the element 240 to form a fluid seal between the isolation assembly 175 and the tubing string 120. Moreover, as depicted in FIG. 2A, in its radially expanded state, the isolation assembly 175 has a generally uniform inner cross section, except for the restriction 205 at its lower end.

In accordance with example implementations, the sleeve 207 may be formed from a metal, such as stainless steel or a metal that has less chromium content per mass than stainless steel, such as SAE grade 4140 metal. The sleeve 207 may be made from other metals or from materials other than metal, in accordance with further example implementations.

Although example implementations are described above in which an expansion tool is drawn through the isolation assembly to deform and radially expand the assembly, other tools and techniques may be used to deform and expand the assembly, in accordance with further example implementations. For example, an expansion tool may be pushed through the isolation assembly to deform and expand the assembly. The expansion tool may have an expansion member that is asymmetrical with respect to the longitudinal axis 201 of the isolation assembly. Moreover, the isolation assembly may be deformed and expanded using a tool or technique that does not involved mechanically contacting the sleeve 207 with an expansion member. For example, in accordance with further example implementations, a setting tool may be used to run the isolation assembly 175 downhole and may be constructed to form a temporary and removable seal inside the expanded section 258 (see FIG. 2A) so that the interior of the sleeve 207 may be pressurized (via fluid pumped in from the Earth surface, for example) to cause the contracted section 260 to deform and radially expand; and after this expansion, the setting tool may be actuated to remove the temporary seal so that setting tool may be pulled out of the well.

As another example, a setting tool may be used to run the isolation assembly 175 downhole, may be constructed to form one or multiple temporary and removable seal(s) inside the sleeve 207, and the setting tool may contain a chemical agent (a gas producing agent, for example) that is activated (via an activating agent communicated from the Earth surface of the well or released from the tool in response to the tool being actuated from the Earth surface of the well, as examples), which causes sufficient pressure to build up inside the sleeve 207 to deform and radially expand the sleeve 207. The setting tool may then be actuated to remove the temporary seal(s) so that the setting tool may be removed from the well.

In accordance with example implementations, the object (such as activation ball 150 of FIG. 2C) may be removed from the restriction 205 of the isolation assembly 175 after completion of the downhole operation that uses the corresponding fluid barrier. The removal of the object permits well access downhole of the isolation assembly 175. In accordance with example implementations, the isolation assembly 175 may remain in place, secured to the tubing string 120, after the object is removed. In this manner, in accordance with example implementations, the sleeve 207, in the radially expanded state of assembly 175, has a relatively large inner diameter that is close in size to the inner diameter of the tubing string 120, and the restriction 205 is sufficiently large enough to allow equipment to pass through.

In accordance with some implementations, the sleeve 207 and/or the untethered object that is ultimately seated in the sleeve 207 may be constructed from a milling material so that a milling tool may be run into the well to mill out the object and/sleeve when the fluid barrier is no longer needed, in accordance with example implementations.

In accordance with further example implementations, the object and/or one or more components of the isolation seat assembly 175 may be constructed from dissolvable or degradable materials. As an example, dissolvable, or degradable, alloys may be used similar to the alloys that are disclosed in the following patents, which have an assignee in common with the present application and are hereby incorporated by reference: U.S. Pat. No. 7,775,279, entitled, "DEBRIS-FREE PERFORATING APPARATUS AND TECHNIQUE," which issued on Aug. 17, 2010; and U.S. Pat. No. 8,211,247, entitled, "DEGRADABLE COMPOSITIONS, APPARATUS COMPOSITIONS COMPRISING SAME, AND METHOD OF USE," which issued on Jul. 3, 2012.

In accordance with an example implementation, the object may be constructed from a dissolvable or degradable material that is constructed to sufficiently dissolve/degrade after a certain time (a week, several weeks, a month, several months, and so forth) to purposefully compromise the structural integrity of the object so that the object collapses or otherwise loses its ability to be retained in the restriction 205 so that the object falls out of the restriction 205. In accordance with an example implementation, one or more of the anchor members 230 may be constructed from a dissolvable or degradable material that is constructed to sufficiently dissolve/degrade after a certain time to compromise the ability of the anchor members 230 to secure the isolation assembly 175 to the wall of the tubing string 120 so that the assembly 175 releases from the string 120.

Although implementations are discussed herein in which the isolation assembly 175 may be used as a fracturing plug assembly to form a fluid barrier for a well stimulation operation, the isolation assembly 175 may be used to form a fluid barrier for downhole operations, other than well stimulation operations. For example, the isolation assembly 175 may be used to form a fluid barrier to pressurize a fluid column for such purposes as firing a tubing conveyed pressure (TCP) perforating gun; actuating a downhole tool; shifting a sleeve valve; and so forth.

Therefore, in general, the isolation assembly 175 may be used for a wide variety of downhole operations, such as shifting a downhole operator; diverting fluid; forming a downhole obstruction; operating a tool; and so forth. Although implementations are discussed herein in which the expansion tool and isolation assembly 175 are run, or deployed, downhole as a unit, in accordance with further example implementations, the setting tool and isolation assembly may be run downhole separately.

Figure 3A:
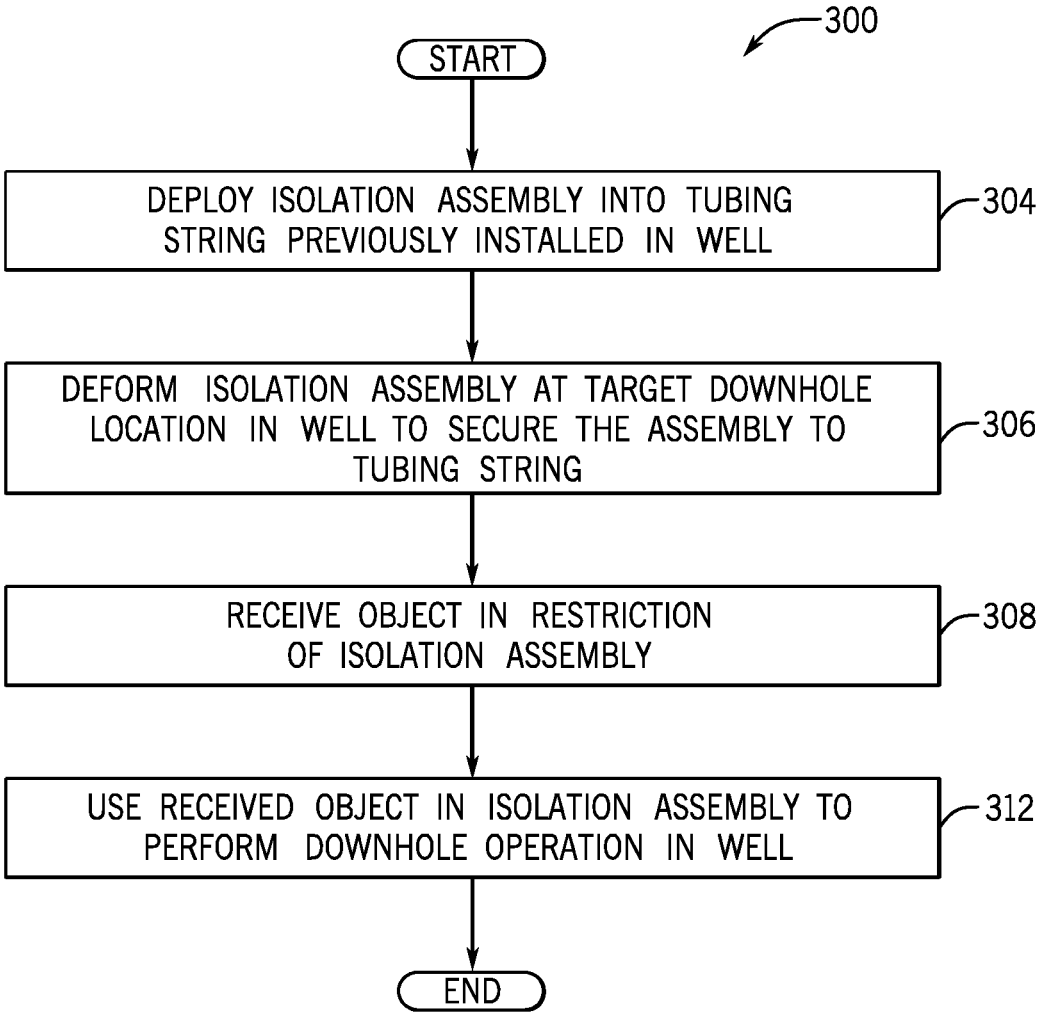
FIGS. 3A, 3B, 8A and 8B are flow diagrams depicting techniques to form and use a fluid barrier constructed from a deformable isolation assembly according to example implementations.

Referring to FIG. 3A, to summarize, in accordance with example implementations, a technique 300 includes deploying (block 304) an isolation assembly into a tubing string that has been previously installed in a well. The isolation assembly is deformed (block 306) at a downhole location in the well to secure the assembly to the tubing string. Pursuant to the technique 300, an object may be received (block 308) in a restriction of the isolation assembly; and the received object may then be used (block 312) in the isolation assembly to perform a downhole operation in the well.

In this context of this application, "deforming the isolation assembly" refers to distorting at least one component of the isolation assembly. Depending on the particular implementation, this distortion may involve radially expanding the component(s), radially contracting the component(s), and as well as other distortions of the component(s).

Figure 3B:
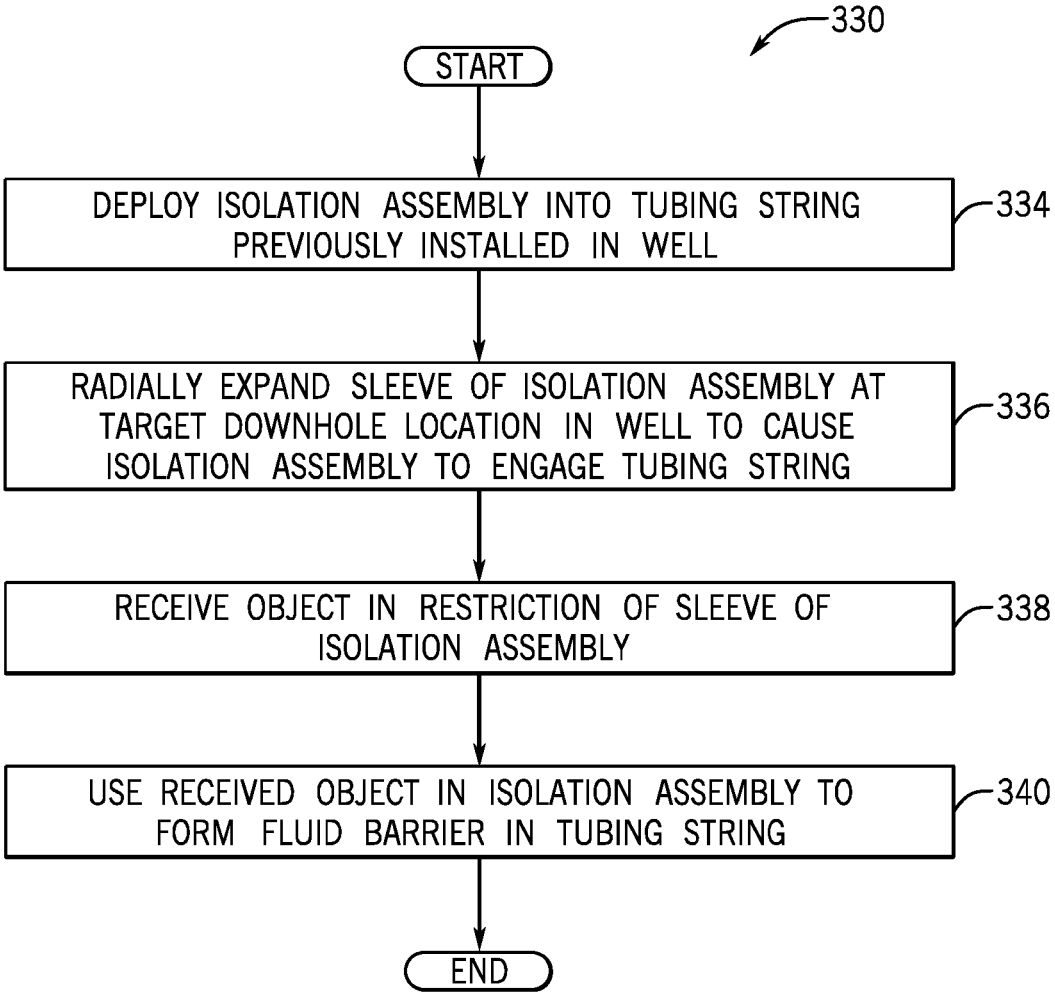

As described above, in accordance with some implementations, a sleeve of the isolation assembly is deformed, and a restriction of the sleeve is used to catch an object to form a fluid barrier. More specifically, referring to FIG. 3B, in accordance with example implementations, a technique 330 includes deploying (block 334) an isolation assembly into a tubing string that has been previously installed in a well. The technique 330 includes radially expanding (block 336) a sleeve of the isolation assembly at a target downhole location in the well to cause the isolation assembly to engage the tubing string. An object is received (block 338) in a restriction of the sleeve, and the received object may then be used (block 340) to form a fluid barrier in the tubing string.

Figure 4A:
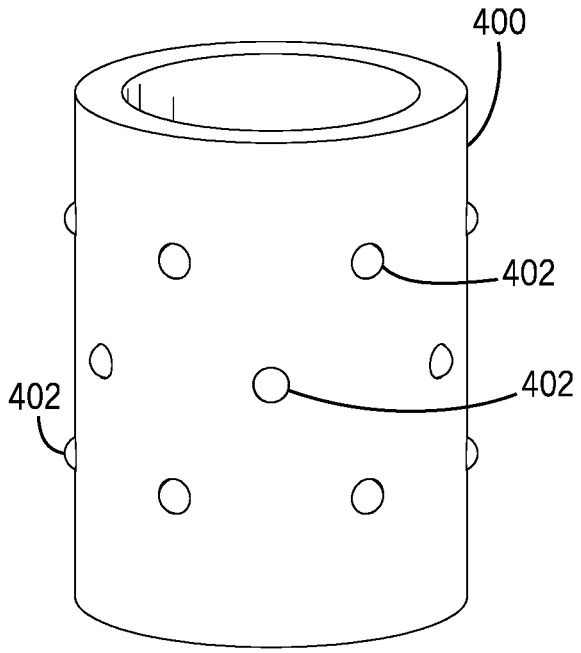
FIGS. 4A, 4B, 4C and 4D depict sleeves and anchoring members for an isolation assembly according to example implementations.

In accordance with further example implementations, the sleeve of the isolation assembly may contain features that enhance the anchoring of the assembly to the tubing string wall. These anchoring features may be used in lieu of a separate anchoring member of the isolation assembly (i.e., an anchoring member separate from the sleeve) or in conjunction with a separate anchoring member, depending on the particular implementation. Referring to FIG. 4A, as a more specific example, in accordance with further example implementations, an isolation assembly may include a sleeve and "bumps," or protuberances 402, that are distributed about the outside of the sleeve 400. The protuberances 402 serve as anchoring members to enhance the gripping of the sleeve 400 to the tubing member 120 when the sleeve 400 is expanded.

Figure 4B:
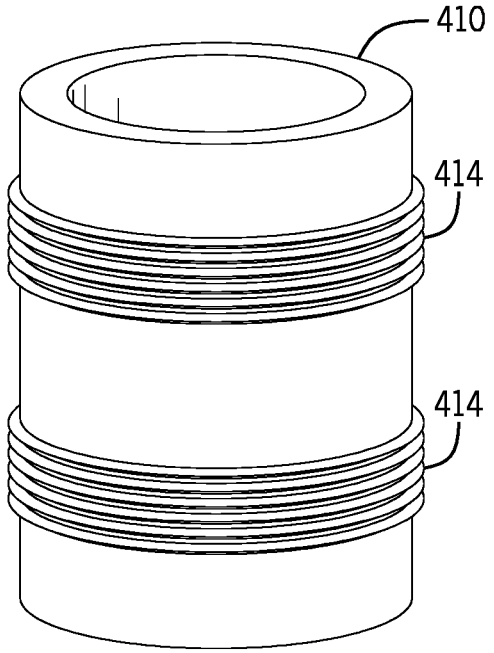

Referring to FIG. 4B, in accordance with further example implementations, an isolation assembly may include a sleeve 410 and slip rings 414 that circumscribe the sleeve 410. The slip ring 414 has teeth that penetrate into the tubing string 120 to anchor the isolation assembly to the string 120 when the sleeve 410 is expanded.

Figure 4C:
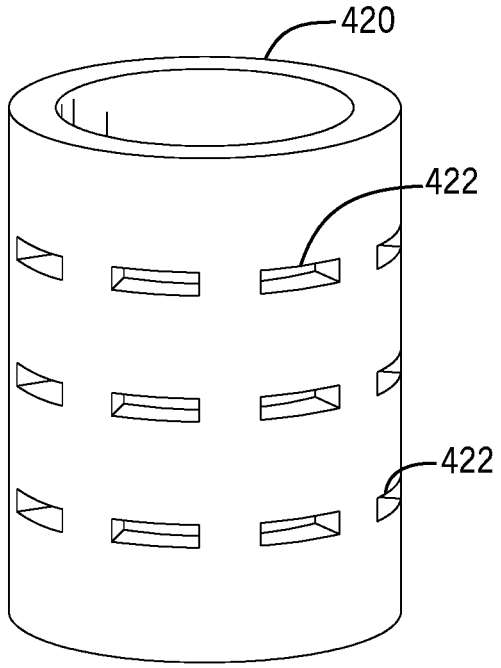

Referring to FIG. 4C, in accordance with further example implementations, the sleeve 420 may be a slotted tubing. In this manner, slots 422 of the sleeve 420 enhance the sleeve's 420 deformation such that the sleeve 420, when expanded, conforms to the tubing string 120 to anchor the isolation assembly in place.

Figure 4D:
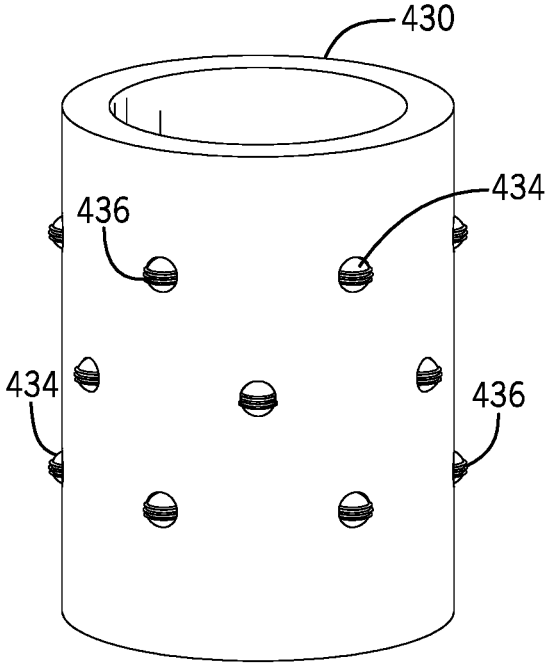

Referring to FIG. 4D, in accordance with further example implementations, an isolation assembly may include a sleeve 430 that has protuberances 434 that are distributed about the outside of the sleeve 430. As depicted in FIG. 4D, the protuberance 434 may have teeth 436 to enhance the anchoring of isolation to the tubing string 120.

Figure 5:
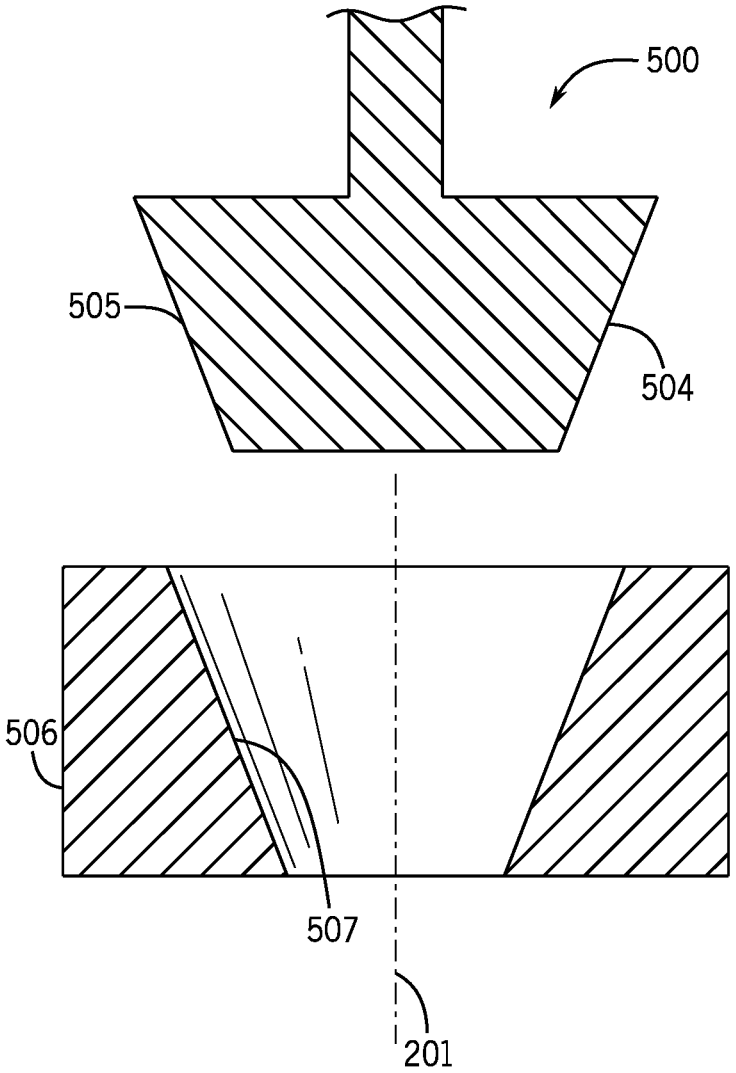
FIG. 5 depicts a cross-sectional view of a setting tool mandrel and a sleeve of an isolation assembly according to a further example implementation.

Referring to FIG. 5, in accordance with further example implementations, a sleeve 506 of an isolation assembly may have a frustoconical surface 507, which circumscribes a longitudinal axis 501 of the sleeve 506. As depicted in FIG. 5, the frustoconical surface 507 is directed uphole so that a slightly larger frustoconical surface 505 of a lower member 504 of a setting tool 500 may be forced inside the sleeve 506 to expand the sleeve 506. In accordance with further example implementations, a sleeve may have a frustoconical surface similar to the frustoconical surface 507, except that the frustoconical surface of this sleeve is facing downhole. In this manner, a setting tool having a frustoconical surface that faces uphole may be run downhole with the sleeve so that the setting tool may be pulled into the sleeve to expand the sleeve.

In accordance with further example implementations, instead of forming an object catching restriction in the sleeve, the isolation assembly may include a seat and a sleeve; and a setting tool assembly may be constructed to wedge the sleeve between the seat and the tubing string for purposes of anchoring the seat in place inside the tubing string. In this manner, the seat and sleeve may be mounted to the setting tool and run into the well as a unit with the setting tool. When at the target downhole location, the setting tool may be constructed to hold one of the seat and sleeve components in place while the setting tool applies a force to axially translate the other component to push the seat and sleeve together to wedge the sleeve between the seat and tubing string wall for purposes of anchoring the isolation assembly in place.

Figure 6A:
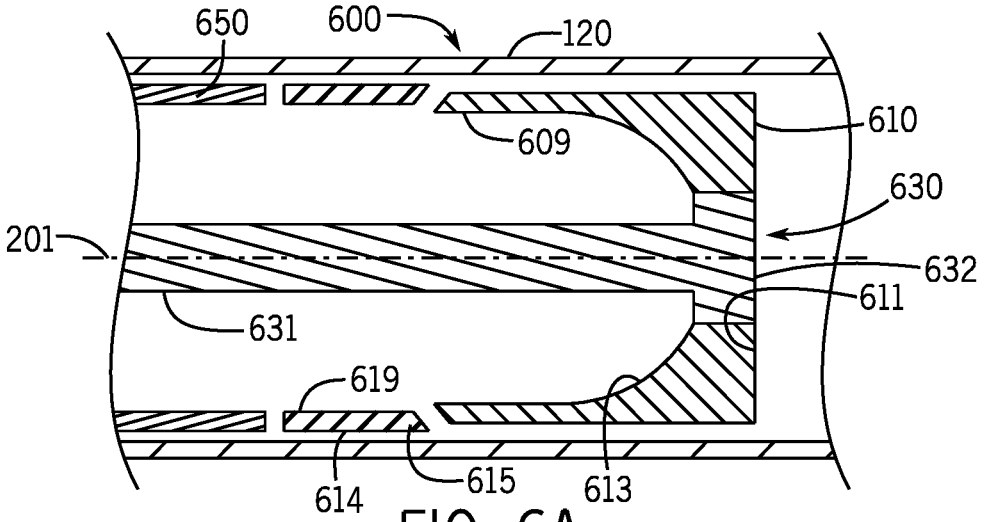
FIG. 6A is a schematic diagram illustrating an isolation assembly in its radially contracted state according to a further example implementation.

As a more specific example, FIG. 6A depicts an isolation assembly 600 that is run downhole on a setting tool 630 in accordance some implementations. The isolation assembly 600 includes a tubular seat member 610 and a sleeve member 614, which both circumscribe the longitudinal axis 201 of the tubing string 120. FIG. 6A depicts the isolation assembly 600 in its run-in-hole state, a state in which the sleeve member 614 is mounted on the setting tool 630 uphole of the seat member 610. The setting tool 630 contains components to push the seat component 610 and the sleeve component 614 together when the isolation assembly 600 is at the target downhole location for forming the fluid barrier: a tension mandrel 631 that extends along the longitudinal axis 201; and a sleeve member 650 that circumscribes the tension mandrel 631.

As depicted in FIG. 6A, in accordance with some implementations, the setting tool tension mandrel 631 may include an enlarged lower, or downhole, end 632, which extends into an opening 611 of the seat member 610 for purposes of engaging the seat member 610 so that an axial force may be applied to the sleeve member 614 to translate the sleeve member 614 along the longitudinal axis 201 toward the seat member 610 to force the sleeve member 614 over and radially outside of the seat member 610.

Figure 6B:
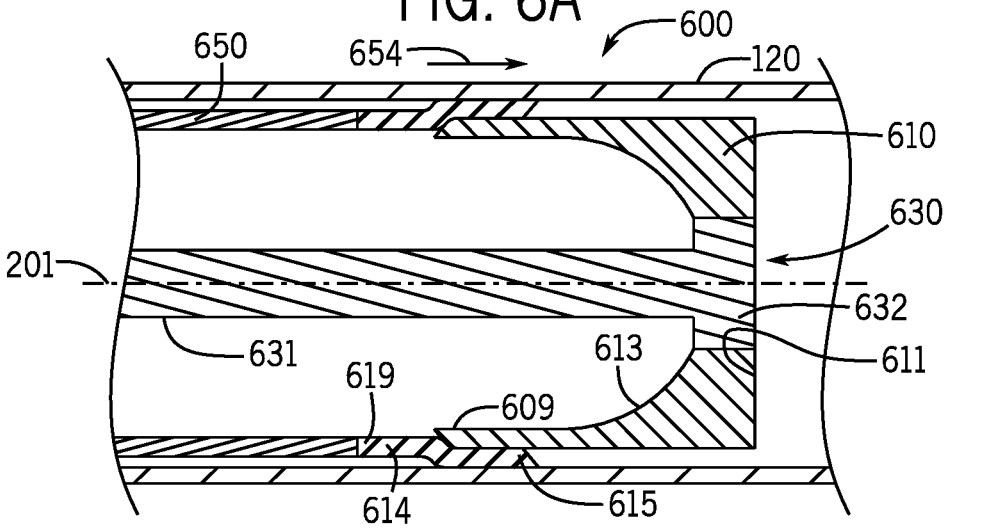
FIG. 6B is a schematic diagram illustrating the isolation assembly of FIG. 6A during the radial expansion of the assembly according to an example implementation.

More specifically, referring to FIG. 6B, the setting tool 630 may be actuated to cause the setting tool sleeve member 650 to contact an upper, or uphole end 619 of the sleeve member 614 to exert an axially-directed force 654 against the sleeve member 614 to axially translate the sleeve member 614. This axial translation causes a lower, or downhole, end 615 of the sleeve member 614 to radially expand and be forced, or wedged, inside the annular space between the seat member 610 and the tubing string wall. As an example, the setting tool 630 may contain a downhole actuator (not shown) that is constructed to be actuated from the Earth surface to pull the tension mandrel 631 in an uphole direction, relative to the sleeve member 650 of the tool 630. In accordance with some implementations, an upper end 609 of the seat member 610 may have an inclined, or beveled, surface for purposes of facilitating the radial expansion of the sleeve member 614. In accordance with some implementations, the lower end 632 of the setting tool 630 may be engaged to the seat member 610 using one or more shear pins (not shown) so that after sufficient force to wedge the sleeve member 614 between the seat member 610 and the tubing string wall is exerted, the shear pins shear to release the setting tool tension mandrel 631 from the seat member 610. This allows the setting tool 630 to be removed from the well.

Figure 6C:
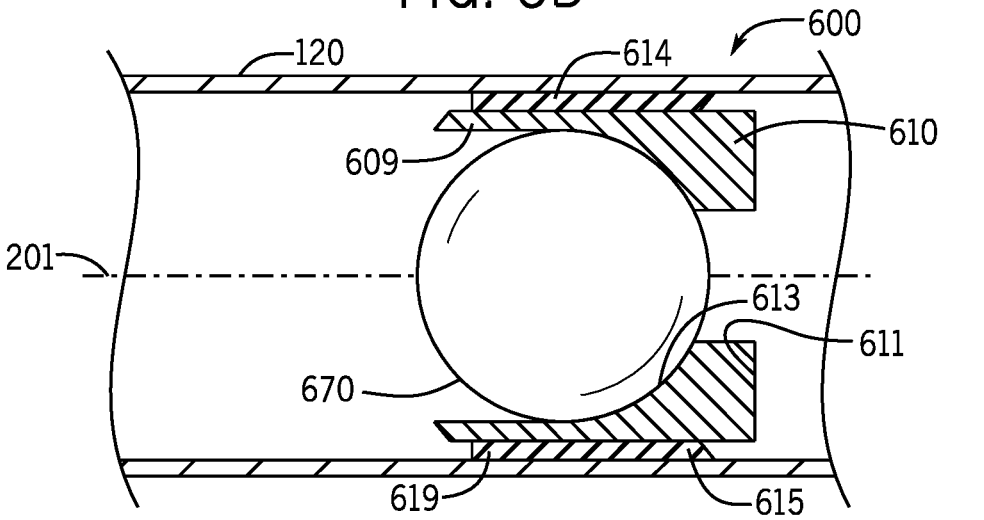
FIG. 6C is a schematic diagram of the isolation assembly of FIG. 6A illustrating the isolation assembly in its radially expanded state according to an example implementation.

FIG. 6C depicts the isolation assembly 600 in its fully set state and further depicts an untethered object, such as an activation ball 670, being seated in the seat 613 of the seat member 610. As depicted in FIG. 6C, the sleeve member 614 is wedged between the seat member 610 and the wall of the tubing string 120. In accordance with example implementations, the sleeve member 614 creates a fluid seal between the seat member 610 and the tubing string wall; and the wedge formed from the sleeve member 614 anchors the seat member 610 to the tubing string 120 to prevent the isolation assembly 600 from moving.

Figure 7A:
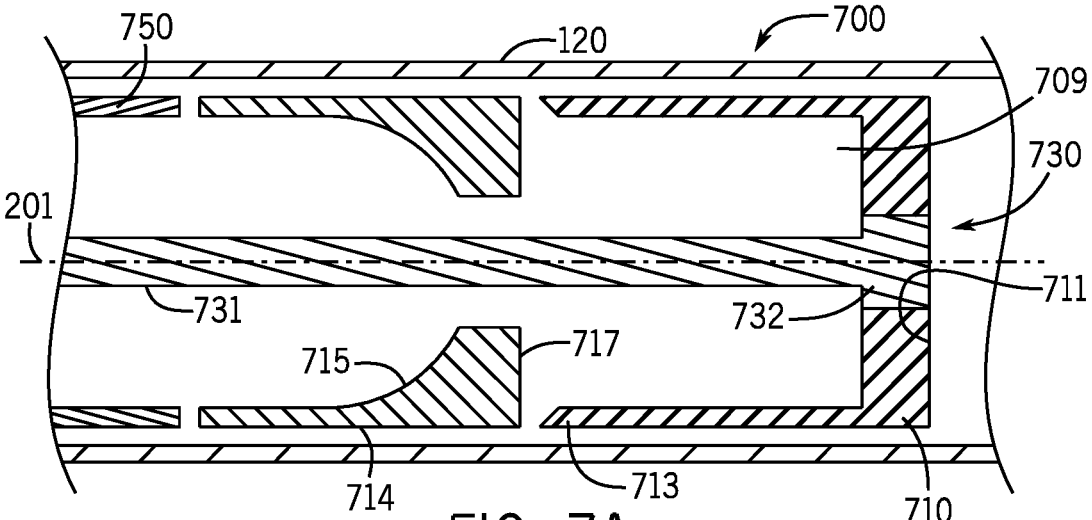
FIG. 7A is a schematic diagram illustrating an isolation assembly in its radially contracted state according to a further example implementation.

In accordance with further example implementations, an isolation assembly may include a seat and a sleeve, which are run downhole on a setting tool, with the seat being mounted to the setting tool uphole of the sleeve. As a more specific example, FIG. 7A depicts an isolation assembly 700 that includes a seat member 714 that is run downhole on a setting tool 730 uphole of a sleeve member 710 of the isolation assembly 700. In this manner, as depicted in FIG. 7A, the sleeve member 710 is secured to a setting tension mandrel 731 of a setting tool 730. The sleeve member 710 includes an opening 711 that receives a downhole end 732 of the setting tool tension mandrel 731. In the run-in-hole state of the isolation assembly 700, which is depicted in FIG. 7A, the seat member 714 has not been pushed into the sleeve member 710 to facilitate running of the isolation assembly 700 into the well. As also shown in FIG. 7A, the setting tool 730 includes a sleeve member 750 for purposes exerting an axial force on the sleeve member 714 to axially translate the sleeve member 714 and force the sleeve member 714 into an interior space 709 of the sleeve member 710.

Figure 7B:
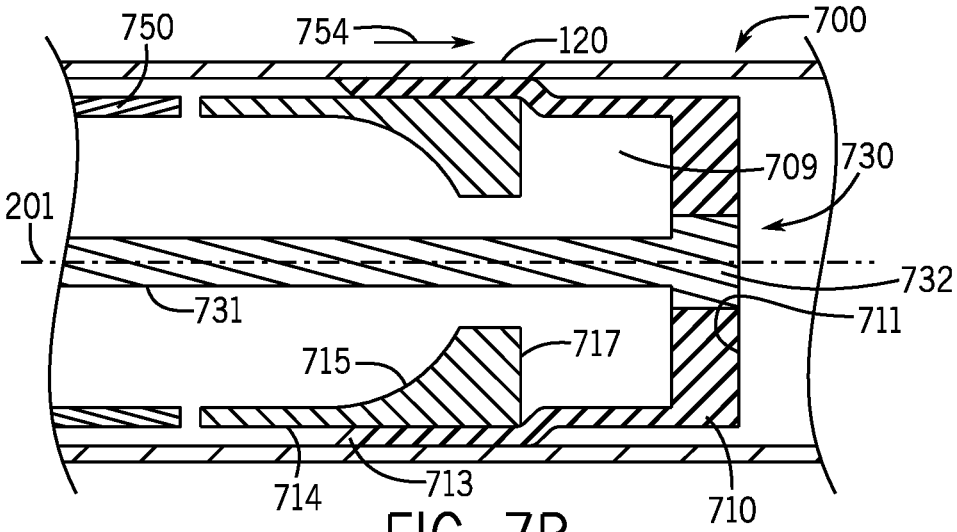
FIG. 7B is a schematic diagram illustrating the isolation assembly of FIG. 7A during the radial expansion of the assembly according to an example implementation.

FIG. 7B depicts actuation of the setting tool 730 in which the setting tool 730 moves the sleeve member 750 in a downhole direction relative to the tension mandrel 731 to exert an axial force 754 on the seat member 714 of the isolation assembly 700. The axial force 734 pushes the seat member 714 toward the sleeve member 710 to force a lower, or downhole end 717 of the seat member 714 into the interior space 709 of the sleeve member 710. During the application of the force 754, the setting tool tension mandrel 731 holds, or secures, the sleeve member 710, as shown in FIG. 7B. Similar to the isolation assembly 600 and setting tool 630 depicted in connection with FIGS. 6A, 6B and 6C, the setting tool tension mandrel 731 may be secured to the sleeve member 710 via one or more shear pins. By forcing the seat member 714 inside the sleeve member 710, an upper, or uphole end 713 of the sleeve member 710 extends in the annular space between the seat member 714 and tubing string wall to form a wedge to secure, or anchor, the seat member 714 in place.

Figure 7C:
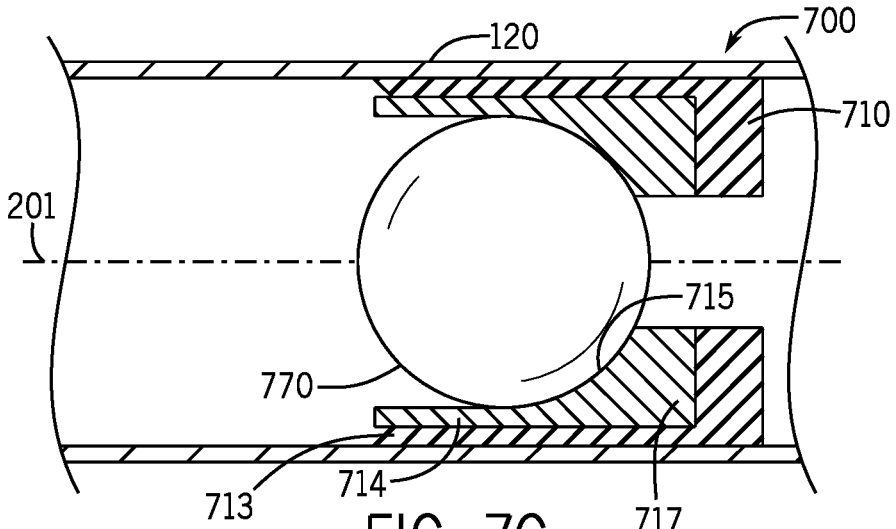
FIG. 7C is a schematic diagram of the isolation assembly of FIG. 7A illustrating the isolation assembly in its radially expanded state according to an example implementation.

FIG. 7C depicts the isolation assembly 700 in its fully set state and further depicts a seat 715 of the seat member 714 receiving an untethered object, such as an actuation ball 770, to form a fluid barrier inside the tubing string 120.

Similar to the isolation assemblies described above, one or multiple components of the isolation assemblies 600 and 700 depicted in FIGS. 6A-7C may be formed from degradable or dissolvable materials. Moreover, one or more components of these assemblies 600 and 700 may be formed from millable materials.

Figure 8A:
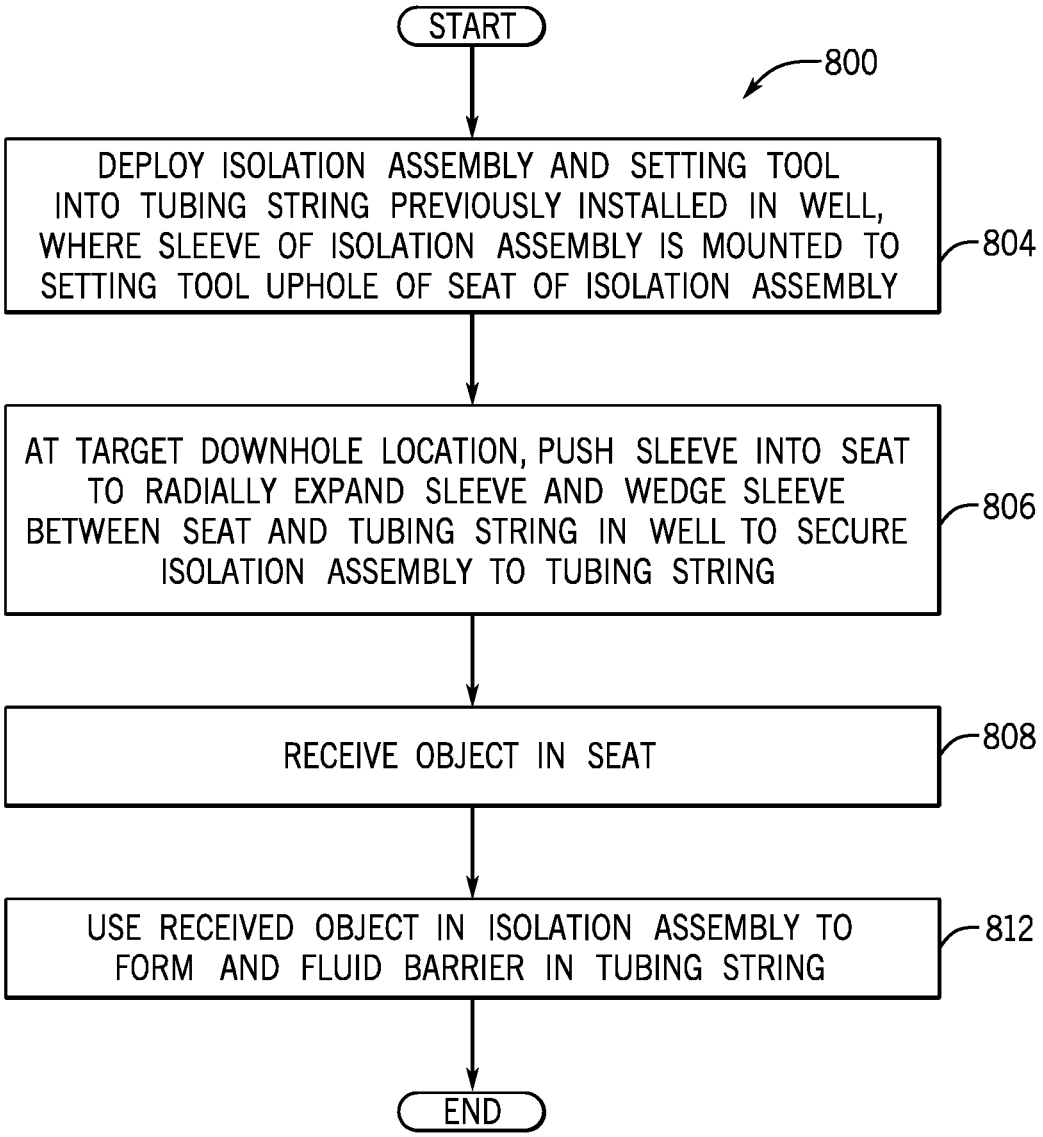

Thus, referring to FIG. 8A, in accordance with example implementations, a technique 800 includes deploying (block 804) an isolation assembly and a setting tool into a tubing string that was previously installed in a well. At a target downhole location, a sleeve of the isolation assembly, which is mounted to the setting tool uphole of a seat of the isolation assembly is pushed (block 806) into the seat to radially expand the sleeve and wedge the sleeve between the seat and the tubing string to secure the assembly to the tubing string. Pursuant to block 808, an object may then be received in the seat, and the received object may be used in the isolation assembly to form a fluid barrier in the tubing string, pursuant to block 812.

Figure 8B:
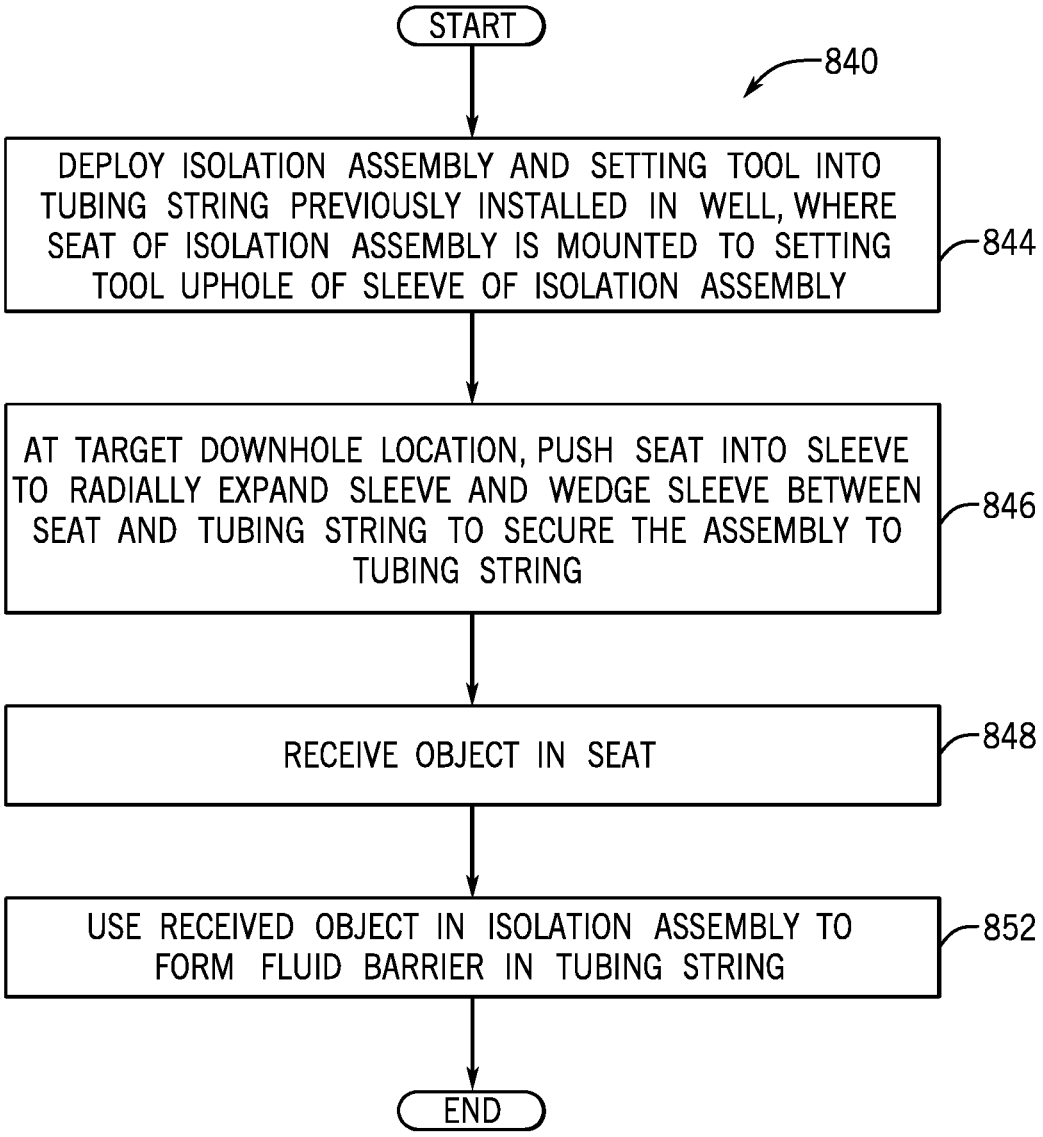

Referring to FIG. 8B, in accordance with further example implementations, a technique 840 may include deploying (block 844) an isolation assembly and a setting tool into a tubing string that was previously installed in a well. At a target downhole location, a seat of the isolation assembly, which is mounted to the setting tool uphole of a sleeve of the isolation assembly is pushed (block 846) into the sleeve to radially expand the sleeve and wedge the sleeve between the seat and the tubing string. An object may then be received in the seat, pursuant to block 848; and the received object may be used (block 852) to form a fluid barrier in the tubing string.

While the present invention has been described with respect to a limited number of embodiments, those skilled in the art, having the benefit of this disclosure, will appreciate numerous modifications and variations therefrom. It is intended that the appended claims cover all such modifications and variations as fall within the true spirit and scope of this present invention.

What is claimed is:

1. A method comprising:

deploying an isolation assembly into a tubing string previously installed in a well, wherein the isolation assembly comprises a sleeve that is coaxial with a longitudinal axis of the isolation assembly, and wherein the sleeve comprises: an expanded section; a contraction section; and a restriction;

deforming the contraction section of the sleeve at a downhole location in the well to secure the isolation assembly to the tubing string, wherein deforming the contraction section of the sleeve comprises radially expanding the contraction section of the sleeve of the isolation assembly in an uphole direction to cause an anchor member of the isolation assembly to radially extend to engage the tubing string, and wherein, prior to deforming the contraction section of the sleeve, the anchor member of the isolation assembly does not engage the tubing string;

receiving an object in the restriction of the sleeve after radially expanding the contraction section of the sleeve; and using the received object to perform a downhole operation as the sleeve remains in the well.

2. The method of claim 1, wherein using the received object in the isolation assembly to perform the downhole operation comprises performing an operation selected from the group consisting essentially of shifting a downhole operator; diverting fluid; forming a downhole obstruction; and operating a tool.

3. The method of claim 1, wherein deforming the contraction section of the sleeve further comprises:

drawing an expander through the sleeve of the isolation assembly to radially expand the contraction section of the sleeve.

4. The method of claim 1, wherein the object comprises an untethered object, the method further comprising:

deploying the untethered object through a passageway of the string to cause the untethered object to travel through the passageway and land in the restriction of the isolation assembly.

5. The method of claim 1, further comprising:

expanding a seal element of the isolation assembly in response to deforming the contraction section of the sleeve to form a fluid seal between the isolation assembly and the tubing string.

6. The method of claim 1, wherein deforming the contraction section of the sleeve of the isolation assembly further comprises:

mechanically deforming the contraction section of the sleeve, deforming the contraction section of the sleeve using a chemical reaction, or applying pressure to deform the contraction section of the sleeve.

7. The method of claim 1, wherein deforming the contraction section of the sleeve further comprises:

radially expanding the contraction section of the sleeve to form a wedge between a seat member of the isolation assembly and a wall of the tubing string.

8. The method of claim 7, wherein:

the isolation assembly is deployed into the tubing string on a setting tool such that the sleeve and the seat member are mounted on the setting tool, and the sleeve is mounted to the setting tool uphole of the seat member; and radially expanding the contraction section of the sleeve comprises actuating the setting tool to push the sleeve and the seat member together.

9. The method of claim 7, wherein:

the isolation assembly is deployed into the tubing string on a setting tool such that the sleeve and the seat member are mounted on the setting tool, and the seat member is mounted to the setting tool uphole of the sleeve; and radially expanding the contraction section of the sleeve comprises actuating the setting tool to push the sleeve and the seat member together.

10. An apparatus usable with a well, comprising:

a tubular assembly having a radially contracted state, the tubular assembly comprising: a sleeve; and a restriction adapted to catch an object deployed into the well to form a fluid barrier when caught by the restriction; and an expansion tool to be deployed downhole with the tubular assembly inside a tubing string, the expansion tool being adapted to radially expand the sleeve of the tubular assembly inside the tubing string in an uphole direction to anchor the expanded sleeve to the tubing string via at least one anchoring member disposed on an exterior of the sleeve, wherein the at least one anchoring member does not engage the tubing string prior to radial expansion of the sleeve of the tubular assembly, and wherein the restriction is adapted to catch the object deployed into the well after radial expansion of the sleeve and removal of the expansion tool.

11. The apparatus of claim 10, wherein the at least one anchor member comprises a slip.

12. The apparatus of claim 10, wherein the at least one anchor member comprises teeth to engage the wall of the tubing string, and wherein the sleeve of the tubular assembly comprises a first section that is contracted for a run-in-hole state of the apparatus and a second section that is expanded for the run-in-hole state of the apparatus.

13. The apparatus of claim 10, further comprising a conveyance mechanism to deploy the expansion tool and tubular assembly downhole.

14. The apparatus of claim 13, wherein the expansion tool is adapted to be drawn through the tubular assembly using the conveyance mechanism to deform the sleeve to radially expand the sleeve.

15. The apparatus of claim 10, further comprising:

a seal element to form a fluid seal between the tubular assembly and the tubing string in response to the radial expansion of the tubular assembly.

16. The apparatus of claim 10, wherein the restriction comprises a seat having a contoured surface to complement a contoured surface of the object.

17. The apparatus of claim 16, wherein the seat is adapted to catch a ball, dart, or barrel.

18. The apparatus of claim 10, wherein the tubular assembly further comprises a seat member, wherein the expansion tool is adapted to exert a force to wedge the sleeve between the seat member and the tubing string to anchor the seat member to the tubing string, and wherein the seat member comprises the restriction.

19. A system usable with a well, comprising:

a casing string to support a wellbore, wherein the casing string has a central passageway and the wellbore has multiple stages;

an isolation assembly to be deployed in the central passageway of the casing string to form an isolation barrier for a given stage of the multiple stages, the isolation assembly comprising:

a tubular assembly having a radially contracted state, the tubular assembly comprising a restriction adapted to catch an object deployed into the well to form a fluid barrier when caught by the restriction, wherein, in the radially contracted state, the tubular assembly comprises an expanded section and a contracted section; and at least one anchor member;

an expansion tool to be deployed downhole with the tubular assembly inside a tubing string; and a conveyance mechanism to deploy the expansion tool and the tubular assembly downhole, wherein the expansion tool is adapted to be drawn through the tubular assembly using the conveyance mechanism to deform the contracted section of the tubular assembly to radially expand the tubular assembly in an uphole direction inside the tubing string to anchor the expanded tubular assembly to the tubing string via the at least one anchor member, wherein the at least one anchor member of the isolation assembly does not engage the tubing string prior to usage of the conveyance mechanism and the expansion tool, and wherein the restriction is adapted to catch the object deployed into the well after radial expansion of the tubular assembly and removal of the expansion tool.

20. The system of claim 19, wherein:

the isolation assembly comprises a fracturing plug assembly.

21. The system of claim 19, further comprising:

wherein the tubular assembly comprises: a sleeve having the contracted section, which is contracted for running the tubular assembly downhole in the central passageway of the casing string, and the expanded section, which is expanded for running the tubular assembly downhole in the central passageway of the casing string; and the at least one anchor member is disposed on the sleeve on the contracted section to anchor the expanded tubular assembly to the tubing string.

* * * * *